US006305613B1

(12) United States Patent
Igwemezie

(10) Patent No.: US 6,305,613 B1
(45) Date of Patent: Oct. 23, 2001

(54) RAIL FASTENING DEVICES

(76) Inventor: Jude O. Igwemezie, 1020 Denison Street, Suite 207, Markham, Ontario (CA), L3R 3W5

( * ) Notice: Subject to any disclaimer, the term of this patent is extended or adjusted under 35 U.S.C. 154(b) by 0 days.

(21) Appl. No.: 08/893,710

(22) Filed: Jul. 11, 1997

Related U.S. Application Data

(63) Continuation of application No. PCT/CA96/00021, filed on Jan. 15, 1996, which is a continuation-in-part of application No. 08/566,327, filed on Dec. 1, 1995, now Pat. No. 5,782,406.

(30) Foreign Application Priority Data

Jan. 13, 1995 (GB) ..... 9500700

(51) Int. Cl.[7] ..... E01B 9/00

(52) U.S. Cl. ..... 238/287; 238/264; 238/351; 238/297

(58) Field of Search ..... 238/349, 351, 238/352, 354, 264, 266, 267, 269, 271, 275, 280, 287, 292, 293, 297, 306, 310, 315, 316, 338, 238

(56) References Cited

U.S. PATENT DOCUMENTS

| | | | | |
|---|---|---|---|---|
| 473,934 | | 5/1892 | Knox | 238/68 |
| 477,112 | | 6/1892 | Graeber | 238/68 |
| 592,907 | | 11/1897 | Gilpin | 238/68 |
| 816,575 | | 4/1906 | Gardin . | |
| 834,682 | | 10/1906 | Rhodes | 238/68 |
| 871,658 | | 11/1907 | Wright | 238/68 |
| 883,562 | | 3/1908 | Nichols | 238/68 |
| 1,054,553 | | 2/1913 | Hoyt . | |
| 1,070,103 | | 8/1913 | Berrien . | |
| 1,181,693 | | 5/1916 | Stults . | |
| 1,745,763 | | 2/1930 | Iida . | |
| 1,888,648 | | 11/1932 | Woodings . | |
| 1,925,124 | | 9/1933 | Warr . | |
| 2,357,629 | * | 9/1944 | Cantrell et al. | 238/349 |
| 2,385,032 | | 9/1945 | Scholes . | |
| 2,533,055 | | 12/1950 | Schulze . | |
| 2,535,337 | * | 12/1950 | Wertz | 238/349 |
| 2,546,046 | * | 3/1951 | Scholes | 238/349 |
| 2,648,500 | * | 8/1953 | Vickroy | 238/349 |
| 3,062,450 | | 11/1962 | Hanff . | |
| 4,074,860 | | 2/1978 | Rex . | |
| 4,373,667 | | 2/1983 | Duchemin . | |
| 4,382,547 | | 5/1983 | Phillips . | |
| 4,943,006 | * | 7/1990 | Clark et al. | 238/351 |
| 4,967,954 | | 11/1990 | von Lange | 238/351 |

FOREIGN PATENT DOCUMENTS

| | | |
|---|---|---|
| 73638/74 | 1/1976 | (AU) . |
| 555 589 | 10/1986 | (AU) . |

(List continued on next page.)

OTHER PUBLICATIONS

Allevard Stedef "Stedef DSA Fastening", 2 pages, no date.
BHP Rail Products (Canada) Ltd. "Steel Ties and Turnouts", 4 page, no date.
Sato Railway Systems "Y–shaped steel sleeper track for railways", 11 pages, no date.
Pandrol Incorporated "Tie plate", 2 pages, no date.
General & Railway Supplies Pty. Ltd. "Rex–Lok–In Rail Fastening System", 6 pages, no date.

*Primary Examiner*—Mark T. Le

(57) ABSTRACT

A rail tie plate suitable for attachment to a wood tie has a pair of upstanding abutment members to accommodate a rail flange, each having an upwardly facing lower ramp surface inclining from a laterally outer side of the abutment member upwardly inwardly to a laterally inner side to facilitate insertion of a rail clip. The tie plate tapers in thickness and has an upper side canted with respect to the lower side. The lower side is provided with wedge shaped projections that tapers laterally in the same direction as the plate and have an end face making an angle no greater than 90° with respect to the lower side.

6 Claims, 10 Drawing Sheets

FOREIGN PATENT DOCUMENTS

| | | | | |
|---|---|---|---|---|
| 384 129 | | 12/1931 | (BE) . | |
| 88 898 | | 10/1896 | (DE) . | |
| 0105110 | | 4/1898 | (DE) . | |
| 0228433 | | 5/1907 | (DE) . | |
| 191 857 | | 11/1907 | (DE) . | |
| 658902 | * | 3/1938 | (DE) | 238/349 |
| 820 010 | | 5/1952 | (DE) . | |
| 10 88 524 | | 9/1960 | (DE) . | |
| 11 88 637 | | 3/1965 | (DE) . | |
| 21 01 434 | | 7/1971 | (DE) . | |
| 0 161 786 | | 11/1985 | (EP) . | |
| 0 162 406 | | 11/1985 | (EP) . | |
| 0 298 904 | | 1/1989 | (EP) . | |
| 393 023 | | 12/1908 | (FR) . | |
| 492 610 | | 7/1919 | (FR) . | |
| 1064956 | | 5/1954 | (FR) . | |
| 1 326 483 | | 4/1963 | (FR) . | |
| 2 561 274 | | 9/1985 | (FR) . | |
| 2 623 827 | | 6/1989 | (FR) . | |
| 6030 | | of 1887 | (GB) | 238/67 |
| 18523 | | of 1900 | (GB) | 238/67 |
| 281544 | | 12/1927 | (GB) . | |
| 330722 | | 6/1930 | (GB) . | |
| 598515 | | 2/1948 | (GB) . | |
| 366302 | | 2/1962 | (GB) . | |
| 1336862 | | 11/1973 | (GB) . | |
| 2 131 472 | | 6/1984 | (GB) . | |
| 2 142 068 | | 1/1985 | (GB) . | |
| WO 93 12296 | | 6/1993 | (WO) . | |
| WO 94 28245 | | 12/1994 | (WO) . | |

* cited by examiner

FIG 21
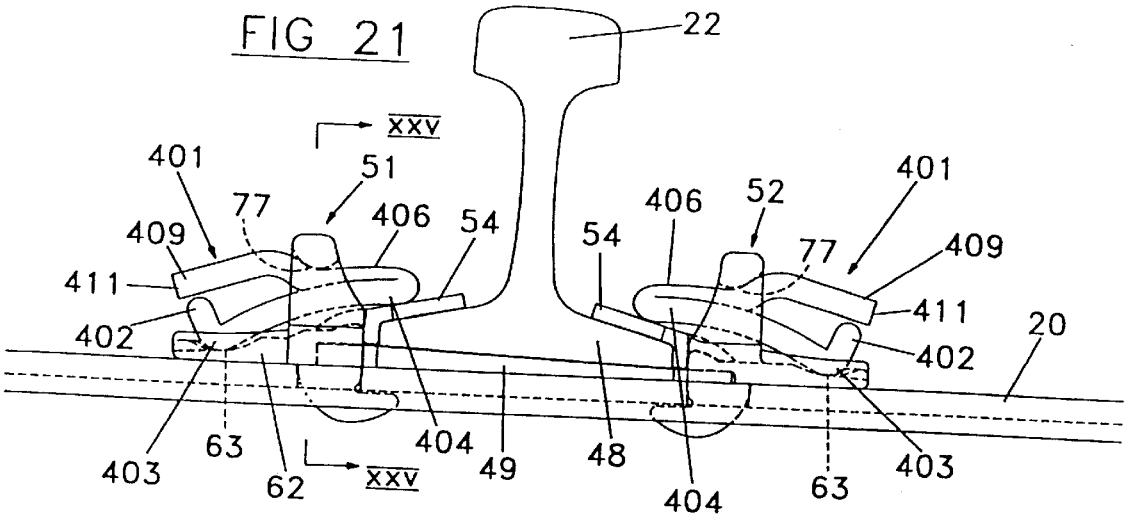
FIG 22
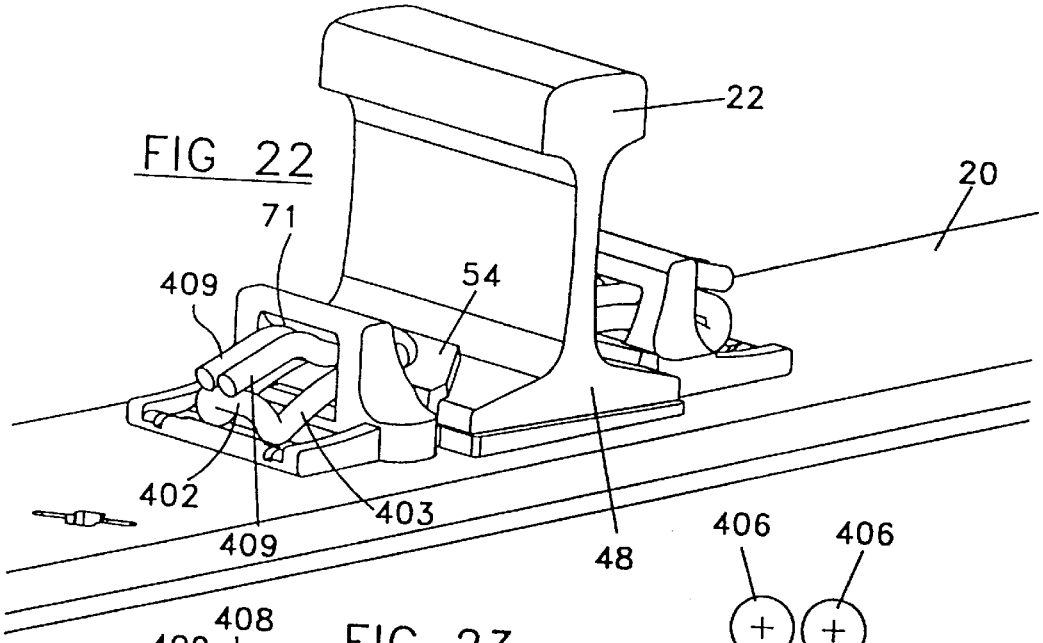
FIG 23
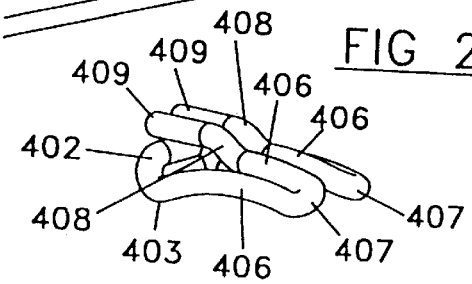
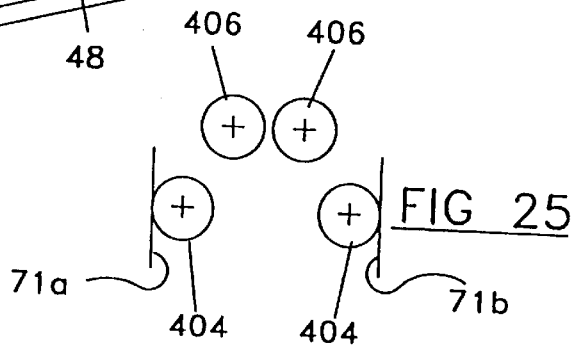
FIG 25
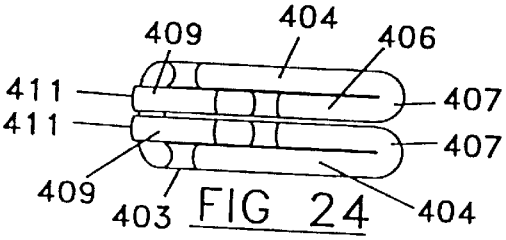
FIG 24
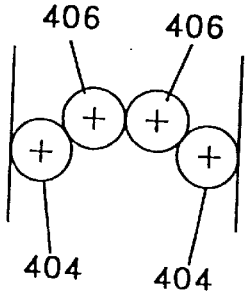
FIG 26

FIG 27
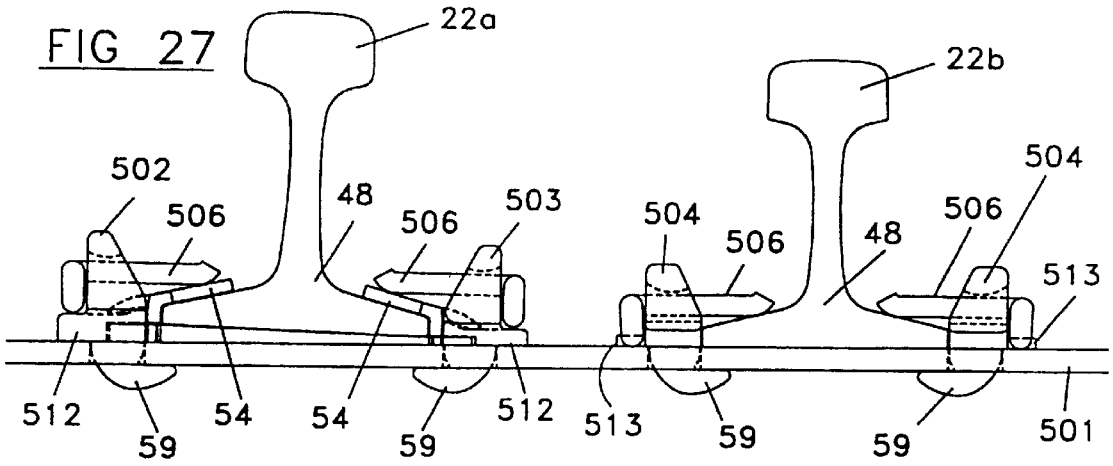
FIG 28
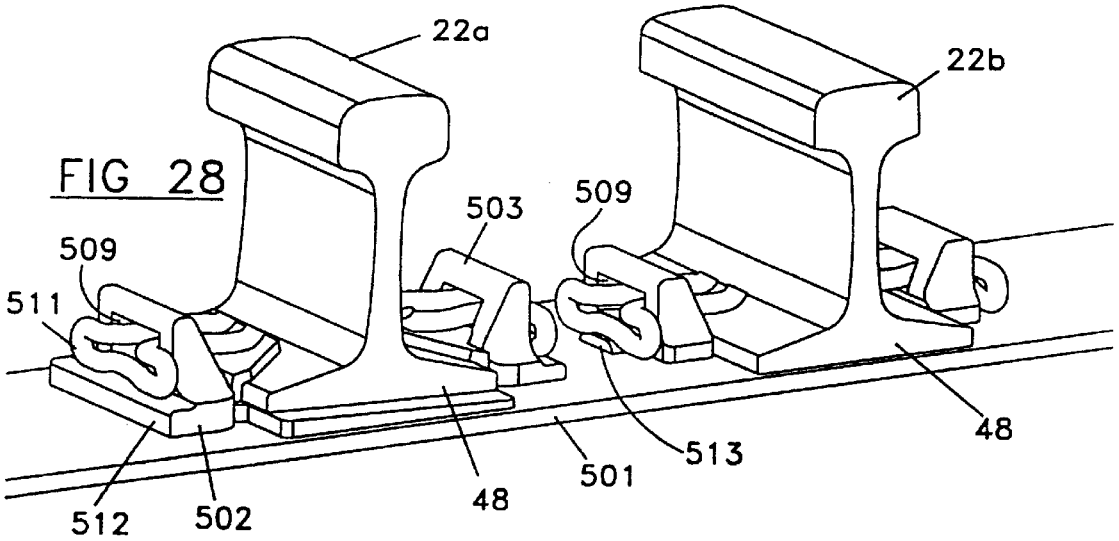
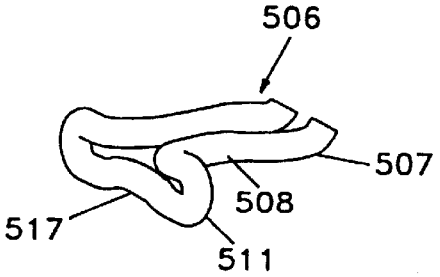
FIG 29
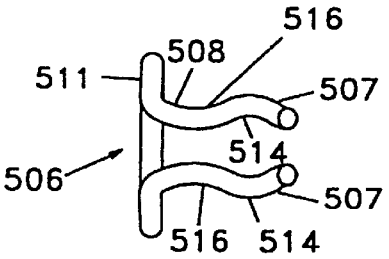
FIG 30

RAIL FASTENING DEVICES

This application is a continuation of application PCT/CA96/00021 filed Jan. 15, 1996 which is a continuation-in-part of application Ser. No. 08/566,327 filed Dec. 1, 1995, now U.S. Pat. No. 5,782,406.

The present invention relates to ties, tie plates, clips and shoulders for incorporation in a rail track. These elements may preferably and advantageously be used in combination, but may be used independently.

In a first aspect, the invention provides a steel tie for incorporation in a rail track, which is a modification of that described in my published application WO 94/28245 and comprises a generally horizontal oblong rectangular plate member for connection transversely of the rail and for restraining vertical rail movement, said oblong plate member having two shorter and two longer sides, each longer side having an outer margin portion inclined downwardly outward relative to the horizontal and a web member extending generally vertically on the underside of the plate member and generally parallel to and spaced inwardly substantially centrally of said longer sides of the plate member and serving to restrain longitudinal rail movement. The margin portions entrance the capture of ballast beneath the tie.

In a further aspect, the invention provides a rail fastening device comprising a pair of opposing longitudinally extending shoulders adapted to accommodate a rail flange therebetween, a downwardly facing abutment surface provided on each shoulder, and a resilient rail clip having an intermediate portion bearing upwardly on said abutment surface, an end portion extending inwardly from said abutment surface and adapted to bear resiliently on an upper side of the flange for restraining the rail against vertical movement, and an outer portion extending outwardly from said abutment surface and curving laterally arcuately outwardly and downwardly toward a lower portion adapted to bear on a bearing surface at a region offset laterally inwardly from a centre of curvature of said outer portion.

This arrangement provides better distribution of stress through the rail clip than known devices of which applicant is aware, and avoid concentrations of stress that may result in failure of the rail fastening device in service. When the above clip in service resists a tendency for the rail flange to lift upwardly, for example to prevent rail roll over, there is a reversal of stress, and hence a point of zero stress in the outer portion between the abutment surface and the lower portions bearing on the bearing surface, and this results in good stress distribution. Having the bearing portion offset laterally inwardly from a centre of curvature of the outer portion results in the clip having increased compliancy, so that installation of the clip is facilitated, and further improves the stress distribution.

In a further aspect, the invention provides a rail retaining device comprising shoulder members for engaging opposite lateral sides of a rail flange, and a rail clip associated with each shoulder member in the form of a bent rod symmetrical about a vertical plane extending laterally of the rail and having an inner portion bearing on the adjacent flange, intermediate limb portions bearing upwardly on a downwardly facing abutment surface provided on the shoulder member and outer portions reacting resiliently on a bearing surface and each comprising a coil spring having a substantial portion thereof extending in a second vertical plane.

The rail clip of this device has the advantage that it is tolerant of dimensional variations in the rail or rail flange, in the shoulder member and in the clip itself, for example arising from manufacturing tolerances, as well as of variations in elevations of the rail flange for example as a result of canting of the rail. The coil spring renders the clip highly compliant. As compared with known bent rod clips of which applicant is aware, the device of the invention greatly reduces the torsional stresses to which the rod is subjected in installation or service.

In a further aspect, the invention provides a rail fastening apparatus comprising a shoulder member engaging at least one side of the rail flange and receiving a rail clip in the form of a resilient rod bent to provide in the installed position limb portions extending transversely of the rail and inner and outer portions adapted to bear on the rail flange and on a bearing surface laterally outwardly of the rail, respectively, said bent rod being generally symmetrical about a vertical plane transverse of the rail, said limb portions comprising an upper pair and a lower pair, and said shoulder member having a reaction surface engaging one of said pairs of limb portions when displaced relative to the shoulder member as a result of upward pressure exerted by said rail flange and displacing said one pair into contact with the other pair to provide a load bearing cross section of increased depth providing increased strength and bending stiffness.

This arrangement allows the rail clip to be formed of relatively thin rod, whereby the clip is made tolerant of dimensional variations, compliant, and relatively easy to install and lightweight and inexpensive to ship. When one pair of the limb portions is displaced into contact with the other, greatly increased strength and resistance to bending is achieved, since the limb portions effectively provide a beam of increased depth of cross-section. As is in itself known, the strength of a beam and its bending stiffness are related to the cube power of the depth of the beam.

In a still further aspect, the invention provides a rail tie plate suitable for attachment to a wood tie, comprising a base plate adapted to be applied to the tie and a pair of abutment members upstanding therefrom to accommodate a rail therebetween and each providing a downwardly facing upper abutment surface for reaction with a laterally inwardly inserted rail clip, and an upwardly facing lower ramp surface inclining from a laterally outer side of each abutment member upwardly inwardly to a laterally inner side thereof for facilitating insertion of the clip to an installed position wherein an inner end of the clip bears resiliently on an inner side of the rail flange.

Whereas known wood tie plates of which applicant is aware have offered difficulties to insertion of rail clips, the ramp surfaces of the above plate facilitate insertion of the rail clip, such as a rail clip as described above, inwardly to an installed position wherein the inner end of the clip bears on a rail flange disposed between the abutment members.

In a further aspect, the invention provides a hook-in shoulder for fastening a rail relative to a horizontal plate member of a tie comprising a shoulder member for bearing toward a rail flange and having a pair of hook-in legs for passing through complimentary apertures in the horizontal plate member of the tie and engaging with the lower side of the horizontal plate member, each shoulder member having an abutment portion upstanding therefrom having an opening therethrough providing a downwardly facing abutment surface for reaction with a rail clip, wherein said abutment portion is box-form and said opening therethrough is bounded by a continuous upper wall providing said downwardly facing abutment surface.

The box form abutment portions offer considerably improved resistance to derailed dragging equipment as compared with known hook-in shoulder members of which applicant is aware.

In a further aspect, the invention provides a hook-in shoulder for fastening a rail relative to a horizontal plate member of a tie comprising a shoulder member for bearing toward a rail flange and having a pair of hook-in legs for passing through complimentary apertures in the horizontal plate member of the tie and engaging with the lower side of the horizontal plate member, each shoulder member having an abutment portion upstanding therefrom having an opening therethrough providing a downwardly facing abutment surface for reaction with a rail clip, and an integral seating portion extending laterally outwardly from the abutment portion and having a lower side bearing on the plate member and an upper side formed with a pit for locating a rail clip.

These shoulders provide a seat for rail clips, such as clips as described above, and facilitate installation and retention of such clips.

In a still further aspect the invention provides a rail retaining device comprising shoulder members for engaging opposite lateral sides of the rail flange, and a rail clip associated with each shoulder member in the form of a bent rod symmetrical about a vertical plane extending laterally of the rail and having an inner portion adapted to engage the adjacent flange, intermediate limb portions adapted to engage upwardly on a downwardly facing abutment surface provided on the shoulder member and outer portions adapted to react on a bearing surface laterally outwardly from the flange and wherein the clip comprises a contact portion varying in width in the direction longitudinally of the rail between the inner and intermediate portions and the shoulder member is adapted to contact said contact portion and resist lateral withdrawal of the clip from the rail.

This device is especially, although not exclusively useful as a zero load retaining device allowing longitudinal movement of the rail relative to the shoulder members but serving to maintain gauge and resist rail rollover.

The above noted aspects of the invention are described in more detail hereinafter, by way of example, with reference to the accompanying drawings.

FIG. 11*a* to *j* are isometric views, respectively, of various forms of rail clip.

Figure 12:
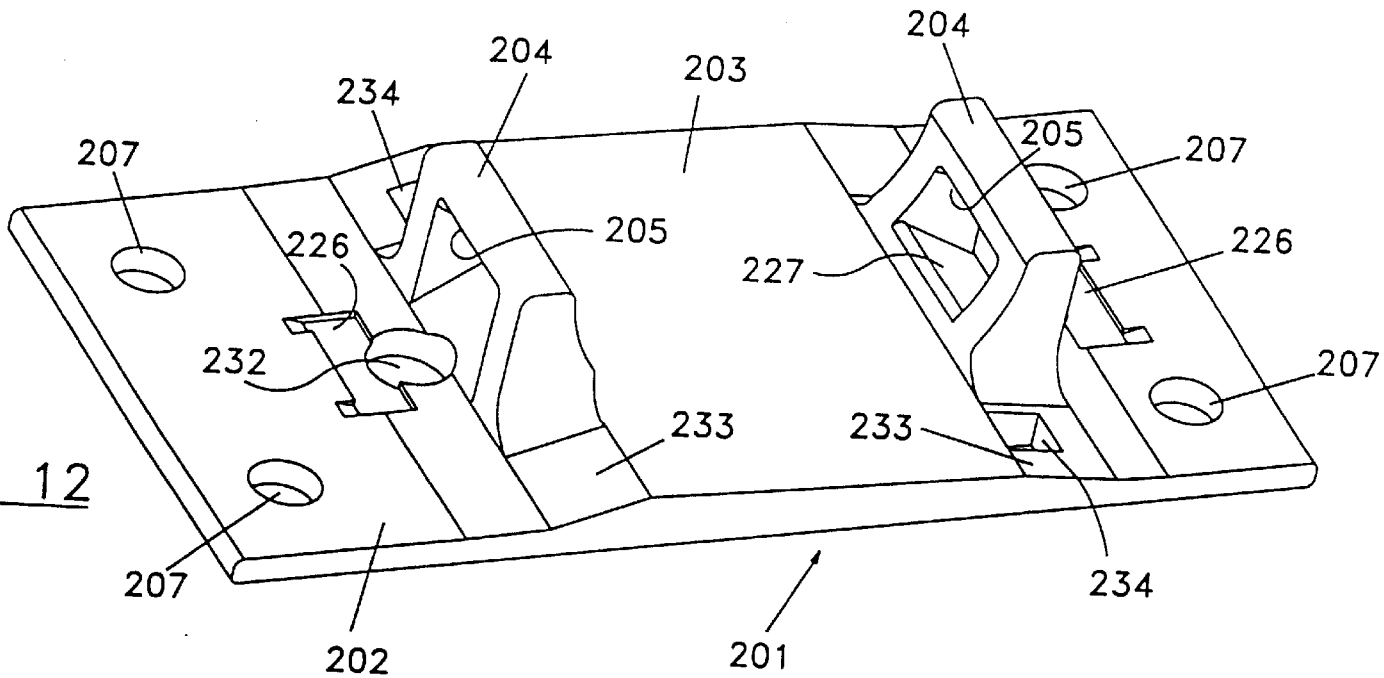

FIG. 12 is an isometric view of a rail tie plate in accordance with the invention.

Figure 13:
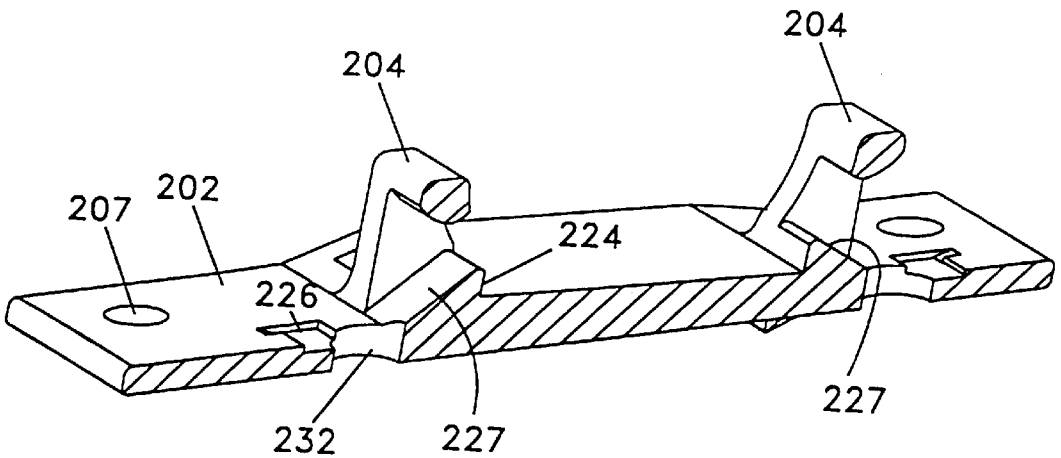

FIG. 13 is a view of the plate of FIG. 12 with portions broken away to show interior structure.

Figure 14:
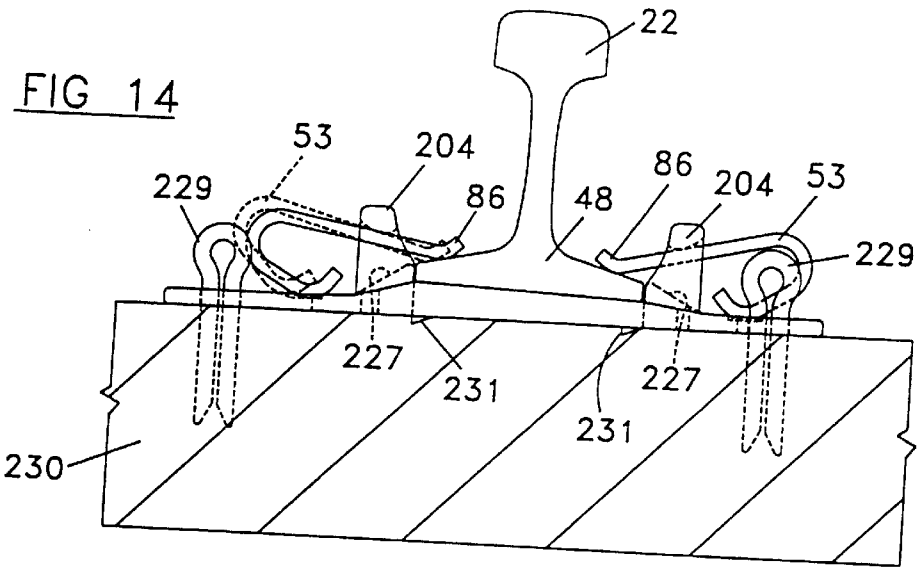

FIG. 14 is a side view partially in section showing the application of the plate of FIG. 12 on a wood tie.

Figure 15:
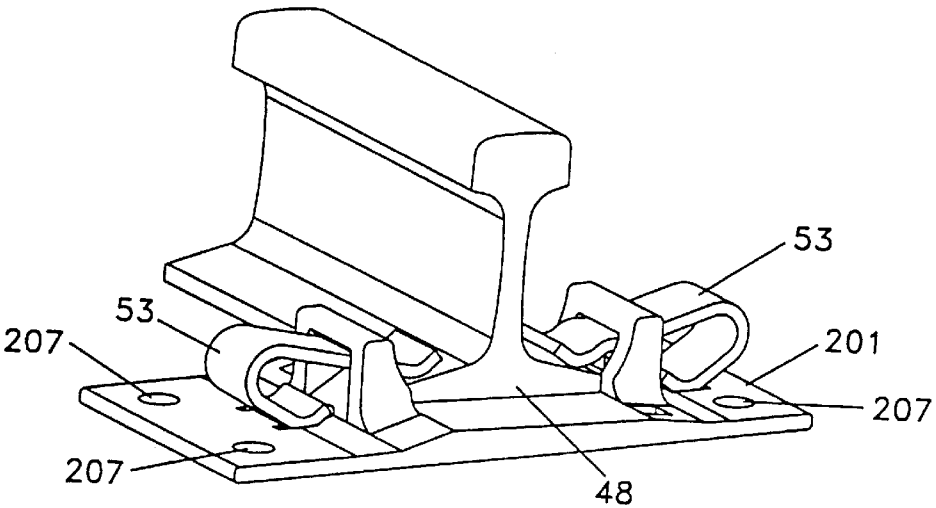

FIG. 15 is an isometric view showing application of the tie plate of FIGS. 12 to 14.

Figure 3:
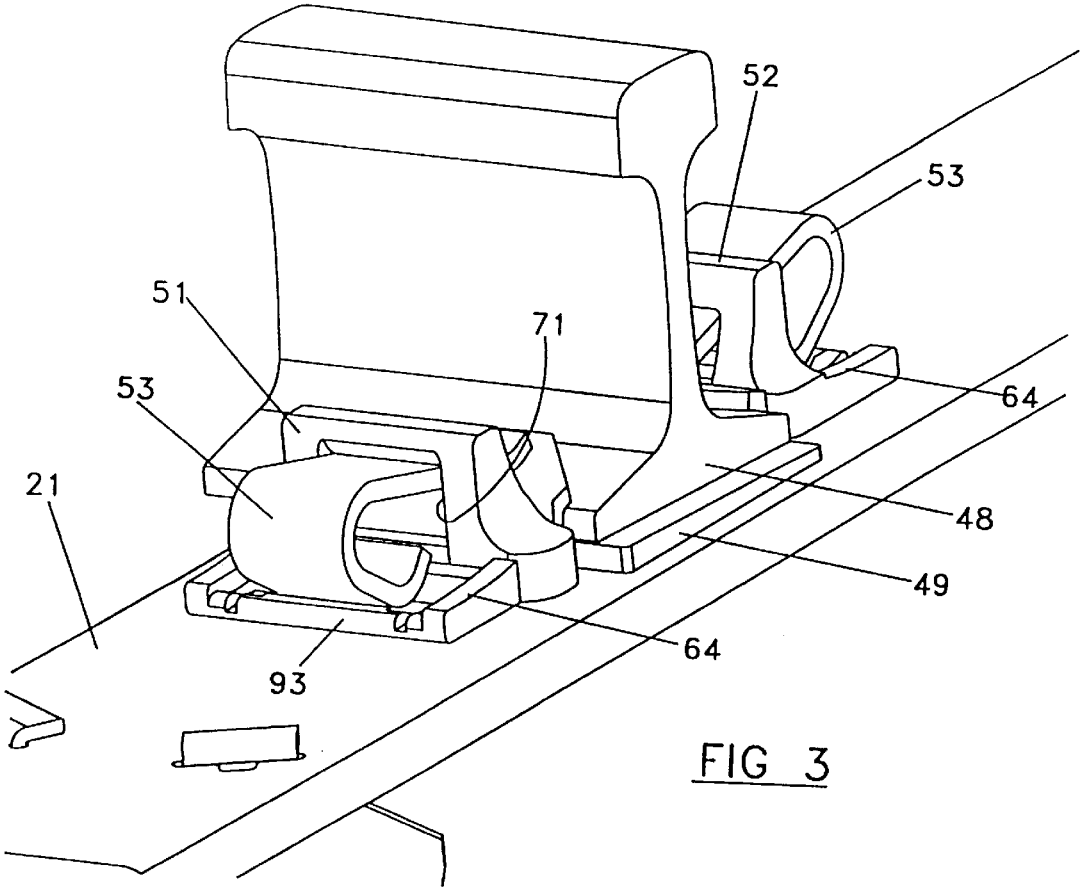
FIG. 3 is an isometric view on an enlarged scale of a rail fastening device shown in FIG. 1.
Figure 7:
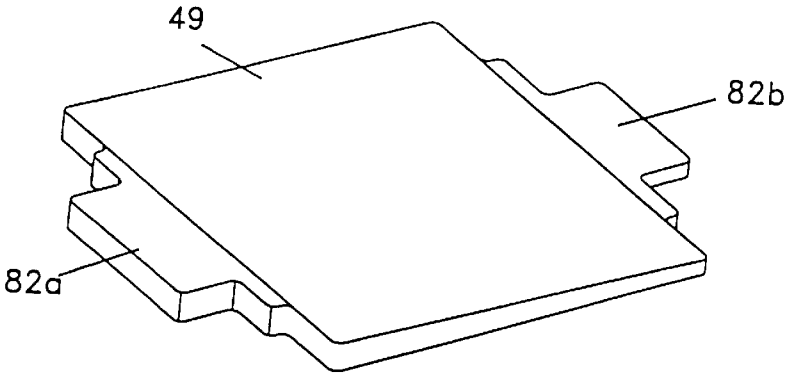
FIG. 7 is an isometric view of an insulating cant or seat plate used in the fastening arrangement of FIGS. 1 to 3.
Figure 6:
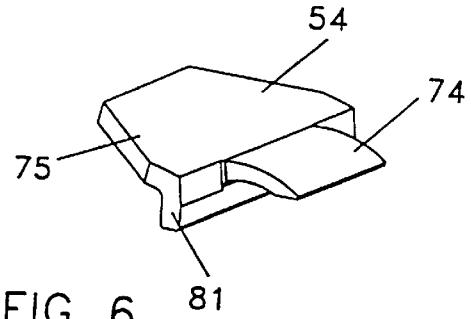
FIG. 6 is an isometric view of an insulator employed in the rail fastening arrangement of FIGS. 1 to 3.
Figure 8:
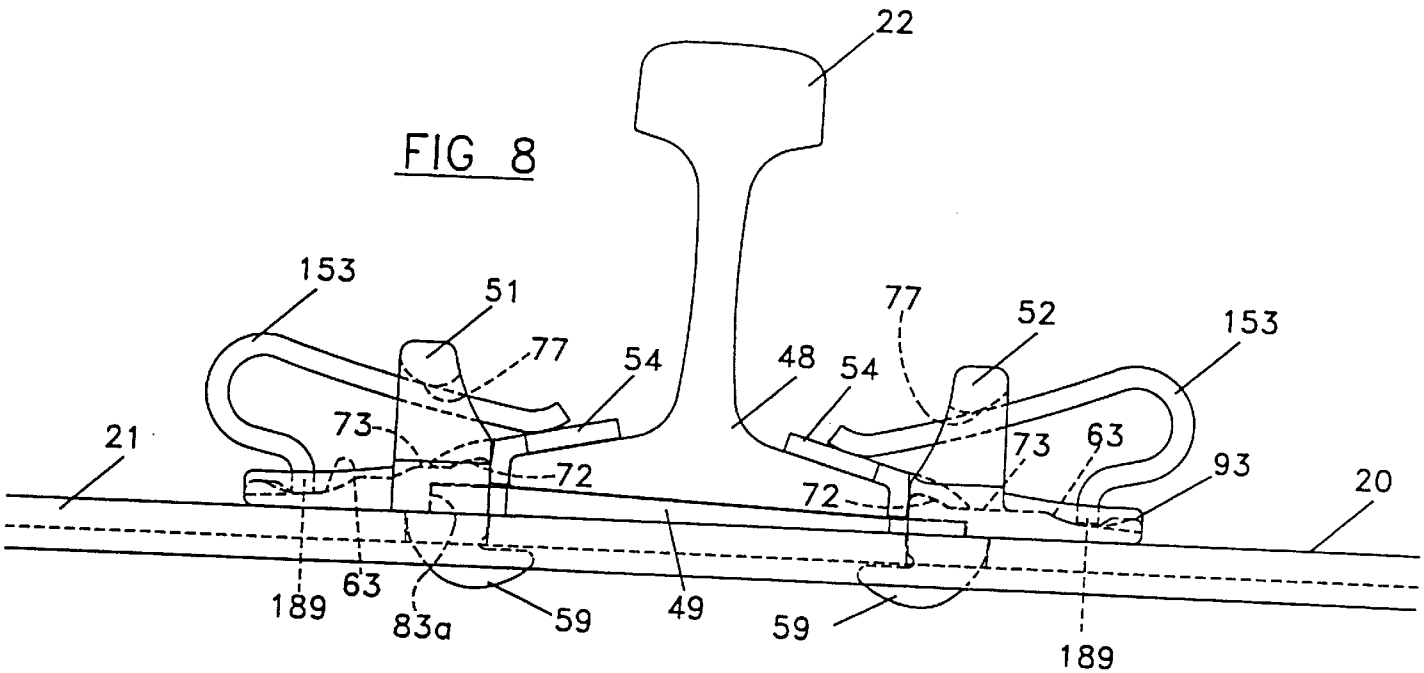
FIGS. 8, 9 and 10 are side views, respectively, of the rail clip fastening device of FIG. 3 modified by incorporation of different forms of rail clip, with internal structure shown by broken lines.
Figure 16:
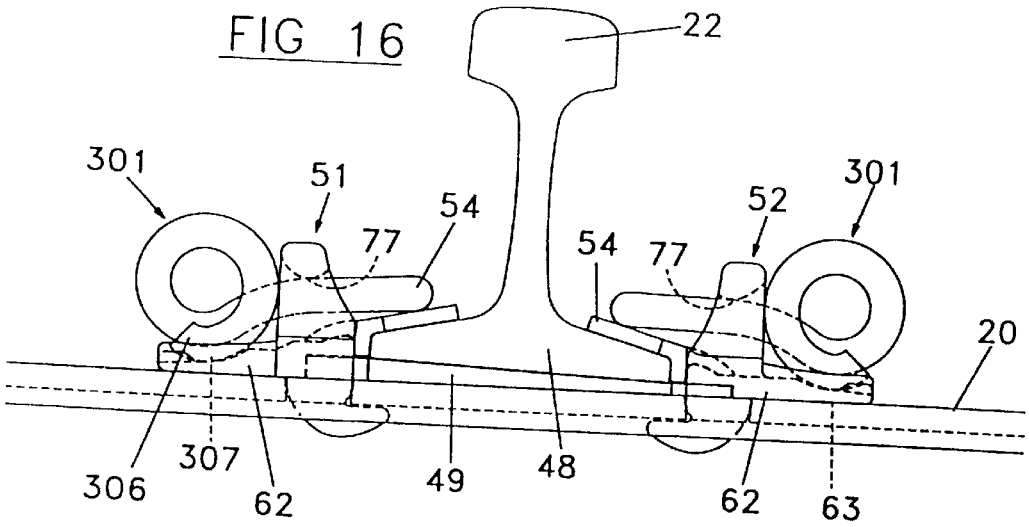
Figure 17:
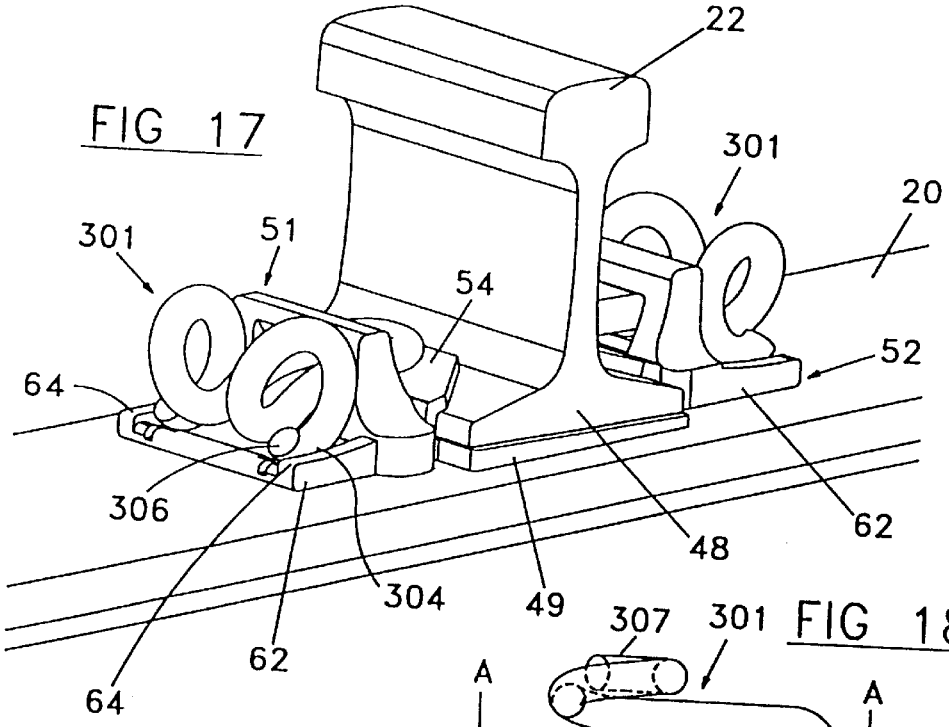

FIGS. 16 and 17 are views corresponding to FIGS. 8 and 3 showing use of a further form of clip.

Figure 18:
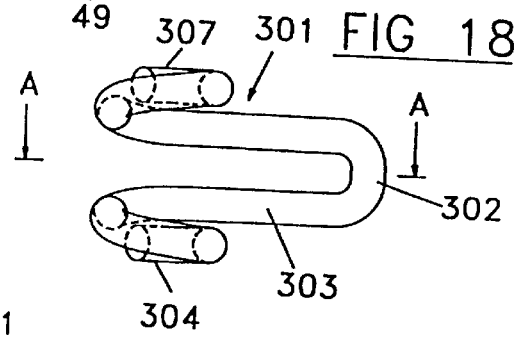
Figure 19:
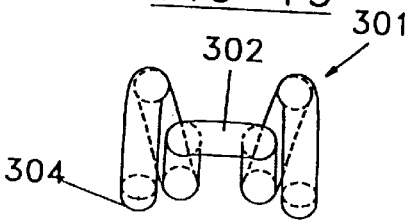
Figure 20:
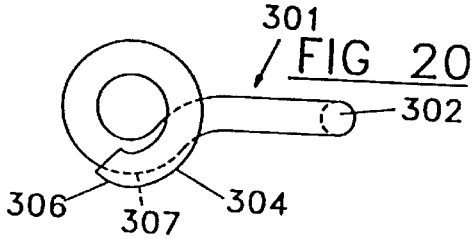

FIG. 18, 19 and 20 are plan, end and side elevational views, respectively, of the clip of FIGS. 16 and 17.

FIG. 21 and 22 are views corresponding to FIGS. 16 and 17 showing use of a still further form of clip.

FIG. 23 and 24 are isometric and plan views, respectively of the clip of FIGS. 21 and 22.

FIG. 25 and 26 are cross-sections taken at the position shown by line XXV—XXV in FIG. 21, showing the configuration of the limb portions in the installed position, and at maximum rail rotation, respectively.

FIGS. 27 and 28 are side and isometric views respectively of rail retaining devices in accordance with a further aspect of the invention applied on a plate-form support.

FIG. 29 is an isometric view of the clip of FIGS. 27 and 28.

FIG. 30 is a plan view of the clip of FIG. 29.

Figure 2:
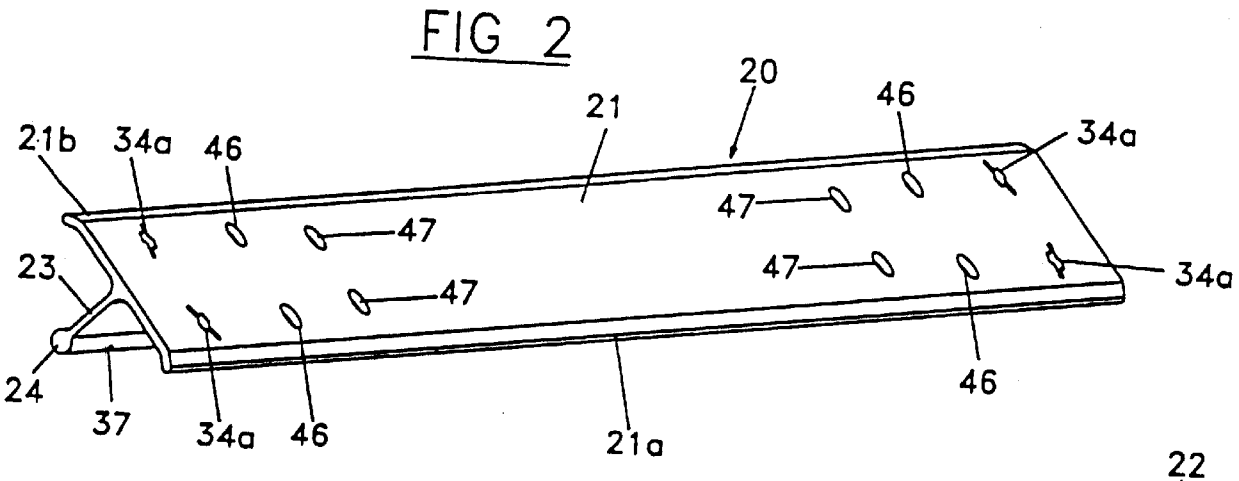
FIG. 2 is an isometric view of a tie employed in FIG. 1.
Figure 1:
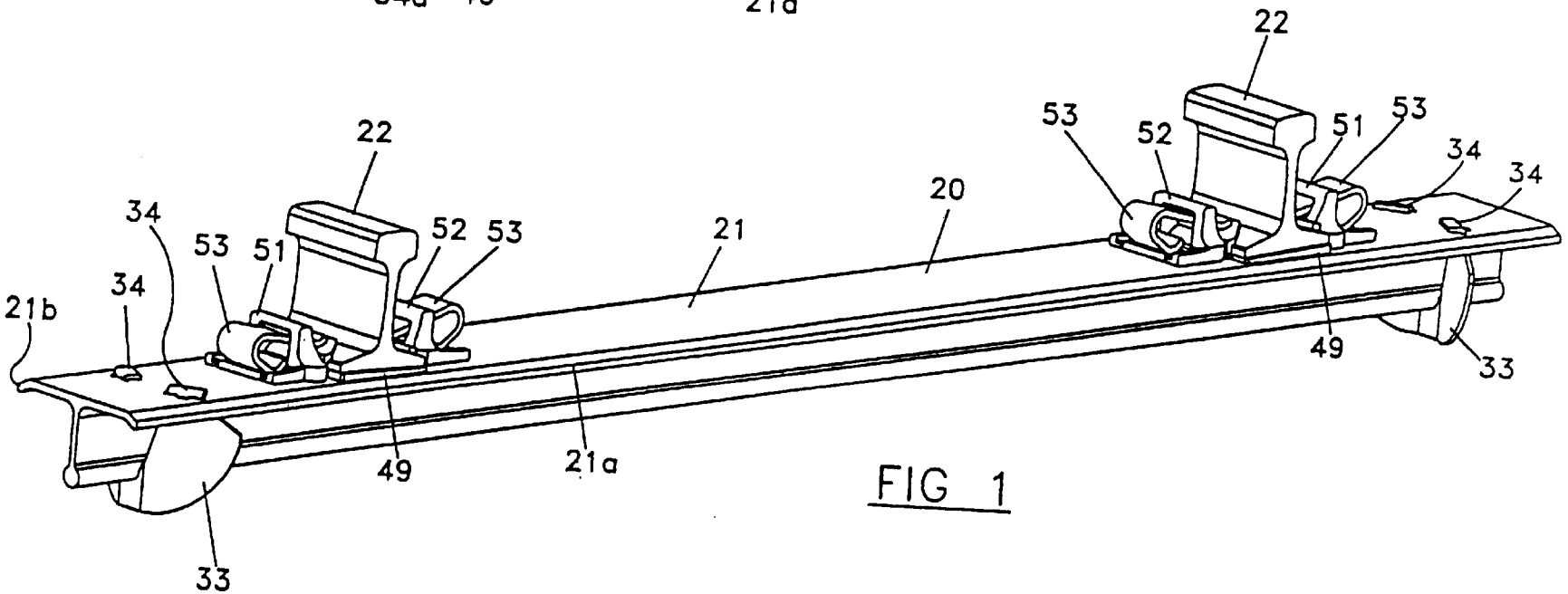
FIG. 1 is an isometric view of a rail fastening arrangement in accordance with the invention.

Referring to the drawings, wherein like reference numerals indicate like parts, FIGS. 1 and 3 show a fastening arrangement employing a steel tie 20 as shown in FIG. 2 comprising a generally horizontal oblong rectangular plate member 21 which is for connection transversely of the rails 22. In FIG. 1, as well as in subsequent Figures, rails 22 and the like are shown as only short lengths for clarity of illustration, whereas it will be appreciated that, in installed track, lengths of rails 22 and the like run continuously over successive ties 20 and the like which are disposed at the usual intervals along the track. Tie is generally similar to that described in WO 94/28245 and has a web member 23 extending substantially centrally between the longer sides of the plate member 21. The lower edge of the web member 23 is formed with a thickened or bulbous portion 24, and the tie 20 is provided with ballast engaging plate members such as a members 33 connected to the tie on its underside through a three point securement. The upper end of each plate member 33 is provided with a pair of upwardly extending end portions 34 passing through slots 34*a* formed symmetrically of the median of the plate member 21 that extends transversely of the rail. The end portions 34 extending above the plate member 21 are bent over or twisted to locate them relative to the plate member 21. The third retaining point for each plate member 33 is provided by a notch 37 formed in the lower side of the bulbous portion 24. Each plate member 33 is formed with a slot in its upper side through which the web member 23 extends. A portion of the plate member adjacent the lower end of the slot lodges in the notch 37.

The preferred form of tie 20 has the plate member 21 generally of uniform thickness and has outer margin portions 21*a* and 21*b* on each longer side that are inclined linearly downwardly outwardly relative to the horizontal plate portion 21. The portions 21*a* and 21*b* serve to capture ballast beneath the plate member 21 and resist any tendency for the tie to sink downwardly into the gravel or other ballast under the tie 20*a*. The linear portions 21*a* and 21*b* avoid rounding of the ballast, since they provide contact normally of their surfaces. This avoids production of fines, fouling of the ballast and poor drainage with attendant risk of electrical grounding of the rail through water contact. The slots 34*a* for reception of the upper end portions of the ballast engaging members 33 are inclined in the direction outwardly from the web structure 23 transversely inwardly towards the centre of the tie 20*a*, to locate ballast engaging plate members 33 having their concave sides directed transversely inwardly toward the centre of the tie 20*a*, as seen in FIG. 1, so as to tend to retain ballast beneath the tie 20*a*.

It may be noted from FIG. 2 that the plate member 21 is formed, on each side of the rails 22 with apertures 46 and 47 that are asymmetric about the longitudinal median of the rail. For example, as seen in FIG. 2, apertures 46 on the laterally outer side of the rail are spaced apart a distance greater than the spacing of the apertures 47 on the inner side of the rail, so that apparatus fastened to openings 46 is non-interchangeable with apparatus fastened to openings 47, for reasons discussed later.

In the rail fastening arrangement shown in FIGS. 1, 3, 8, 9 and 10, the rails 22 are canted inwardly downwardly. The flange 48 of rail 22 is seated on an electrically insulative, e.g. rubber, tapering cant plate 49 interposed between the plate member 21 and the flange 48. The arrangements differ only in the form of rail clip that is employed.

Figure 11:
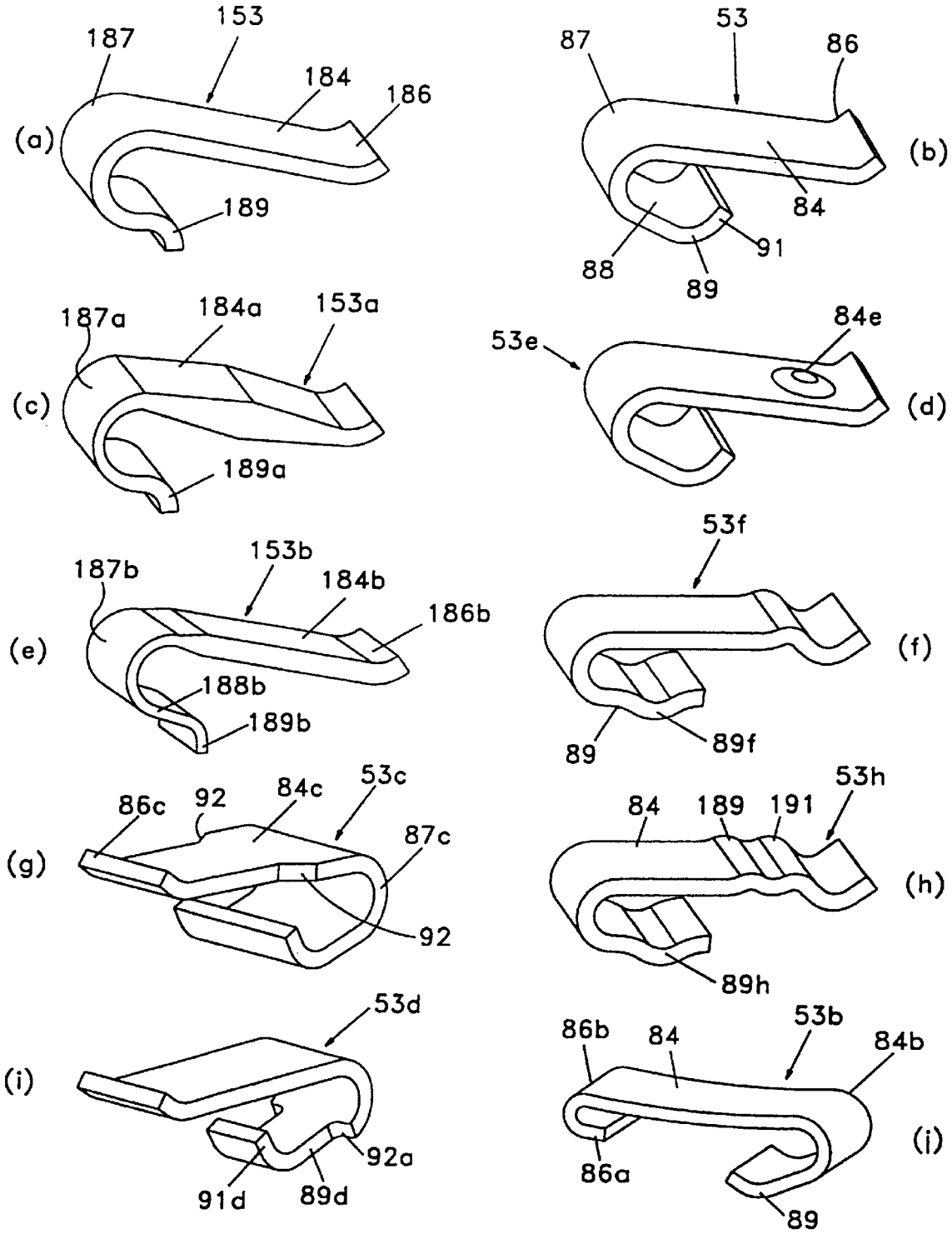

The flange 48 is located between hook-in shoulder members 51 and 52 and retained by rail clips, for example rail clip 53 as seen in FIGS. 1, 3 and 11(*b*), inserted through the shoulder members 51 and 52 and bearing downwardly toward the rail flange 48. In the examples illustrated, electrical insulators 54 are interposed between the clips 53 and flange 48, but it will be appreciated that a similar arrangement may also be employed without the insulators 54 wherein clips 53 or the like bear directly on the flange 48.

Figure 4:
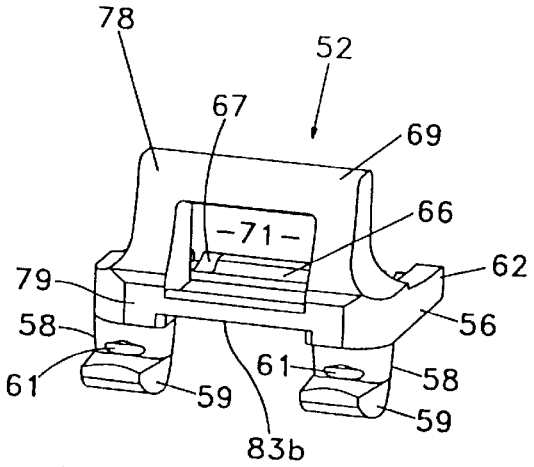
FIG. 4 is an isometric view from one side of a hook-in shoulder employed in the arrangement of FIGS. 1 to 3.
Figure 5:
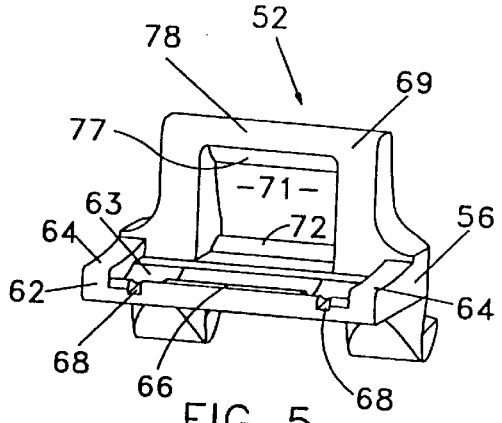
FIG. 5 is a view from the opposite side of the shoulder of FIG. 4.
Figure 9:
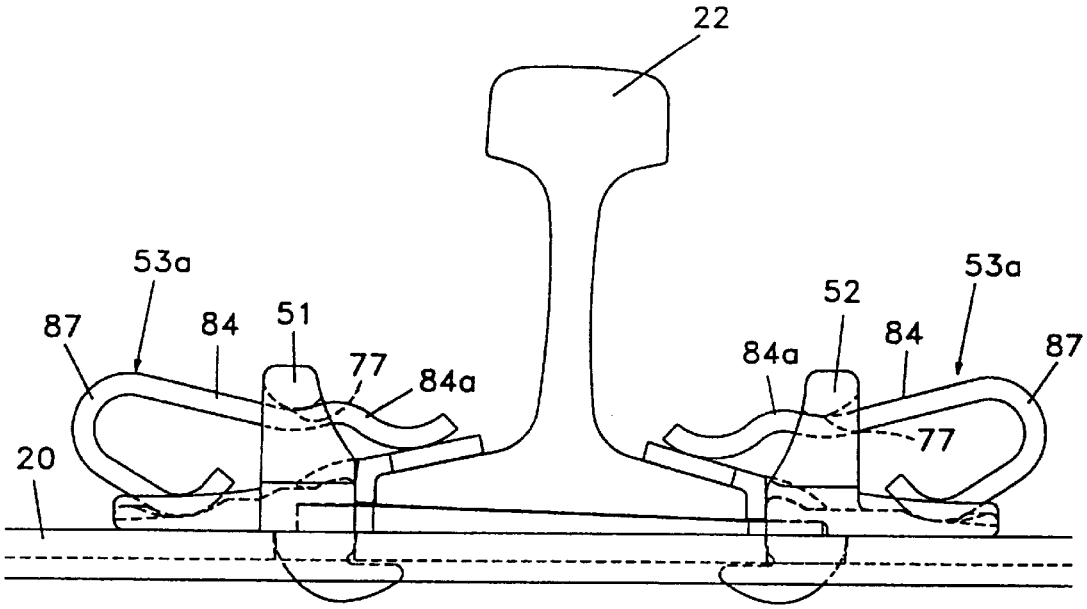

FIGS. 4 and 5 show in more detail the shoulder member 52 comprising a base 56 having a planar lower surface for seating on the plate member 21, and a pair of legs 58 with lateral extensions 59 adapted to be inserted through the openings 46 and to engage the lower side of the plate member 21, as seen in FIG. 9. As seen in FIG. 4, the inwardly facing sides of the legs 58 may be provided with recesses 61 to assist in clearing the edges of the openings 46 during insertion. Laterally outwardly, the base 56 is formed with an extension or seating portion 62 having its lower surface coplanar with the surface 57 and a longitudinally elongated trough-like recess or pit 63 in the upper side for receiving rail clips such as the clip 53 or the like. The pit 63 in this example is generally concave in lateral cross-section, as seen in FIG. 8, and at each end of the trough-like pit 63, the extension is provided with upstanding laterally extending anti-squat walls 64 adapted for confining the limb portions of rod-form clips, as described in more detail later. An outer side of the trough-like pit 63 may be formed with an inwardly directed portion 66, the longitudinally directed end faces 67 of which may act as further longitudinal restraints for rod form clips or the like. Drainage channels 68 extend from the trough-like pit 63 to the outer side of the seating portion 62.

Upstanding from the base 56 is a box-like abutment portion 69 having an opening 71 therethrough to receive the clips 53 or the like. The lower side of the opening 71 comprises an upwardly inwardly inclining ramp surface 72, a generally horizontal portion 73 which may receive an outer end 74 of insulator 54. In the event the clips 53 and shoulders 51 and 52 are employed in the absence of the insulators 54, the ramp surfaces 72 serve to facilitate inward insertion of the clips 53 to the installed position as seen in FIGS. 3, 8, 9 and 10 wherein the inner ends of the clips bear downwardly on the rail flange 48. Further, with the insulators installed, as seen in FIG. 9 the surfaces 72 supports the correspondingly inclined ramp-like portion 75 of the insulators 54 which facilitates installation of the clips 53.

The upper side of the opening 71 comprises a downwardly convex abutment surface 77. It will be noted that the opening 71 is bounded by a continuous upper wall comprising a cross bar portion 78 the lower side of which provides the downwardly facing abutment surface 77. The box form abutment portion 69 with its continuous upper wall 78 provides considerably improved resistance to fracture or deformation of the shoulder portion when exposed to derailed dragging equipment.

The other shoulder portion 51 on the upper side of the rail flange 48 is generally similar to the shoulder described above with reference to FIGS. 4 and 5, except the opening 71 is disposed at a higher elevation relative to the planar lower side of the base 56. The legs 58 of the shoulder portion 52 are spaced a smaller distance apart, corresponding to the spacing of the openings 47, while legs 58 of the shoulder 51 have a spacing corresponding to the openings 46, so that the shoulders 51 and 52 are non-interchangeable, and inner shoulder 52 designed to be applied to the lower side of the canted rail flange 48 cannot inadvertently be installed on the outer or upper canted side of the flange or vice versa.

An inner, preferably generally vertical face 79 of the shoulders 51 and 52 bears directly on and locates the edges of the rail flange 48 or bears toward such edges and locates them with the interposition of a wall portion 81 of the insulator 54. In the case in which the faces 79 bear directly on the edges of the flange 48, the tie 20 is formed with a somewhat smaller spacing than illustrated between the sets of openings 46 and 47.

In the preferred form, the tie plate or pad 49 is a resilient insulating pad as described in applicant's U.S. Pat. No. 5,335,850, issued Aug. 9, 1994.

The pad is formed with tabs 82*a* and 82*b* which are of different lengths and are received snugly in complimentary pockets 83*a* and 83*b* in the shoulder members 51 and 52, respectively, so that the pad 49 cannot inadvertently be installed wrongly and the rail inadvertently canted in opposition to the inclination that matches the shoulders 51 and 52.

It may be noted that, with the insulating pad 49 and insulators 54, the rail 22*a* is electrically isolated from ground, and may be used as a conductor in, for example, an electrically conductive rail signalling system or the like.

The rail clip 53 employed in FIGS. 1 and 3 is formed of bent metal strip and as seen best in FIG. 11(*b*), comprises an upper limb portion 84 that reacts with the abutment surface 77, an upswept inner end or distal portion 86 that bears resiliently downwardly on or toward the flange 48 of the rail 22, for restraining the rail 22 against vertical movement, an outer portion 87 curving laterally arcuately outwardly and downwardly toward a lower limb portion 88 extending to a lower portion 89 that rests in the pit 63 and bears on the extension 62, and an upwardly directed end portion 91.

All the clips shown in FIG. 11 comprise a generally J-like shape wherein the lower portion such as the lower portion 89 that bears on the shoulder 51 or 52 is offset laterally inwardly from the centre of curvature of the arcuate portion 87. As a result, when the inner end portion 86 is loaded upwardly as a result of uplift of the rail flange 48, there is a stress reversal within the clip and a zone of zero stress whereby the stresses are distributed more uniformly through the body of the clip and stress concentrations are avoided.

In use, after installation of the cant plates 49, shoulders 51 and 52, insulators 54 and laying of the rails 22*a* and 22*b*, the inner ends 86 of, for example, the clips 53 are inserted loosely through the openings 71 to rest on the portion 74 of the insulators 54 and pressure applied on the outer portions 87 to cause the lower portion 89 to ride inwardly upwardly over an outer arcuate ramp portion 93 of the extensions or seating portion 62. At this point the upper portion 84 of the clip 53 is compressed by the abutment surface 77 and the clip 53 is driven inwardly until the lower portion 89 snaps into the pit 63 in the installed position seen in FIG. 3.

In the installed position the compressive reaction on the clip 53 between the surfaces 63 and 77 result in a strong downward toe load exerted on flange 48 by end portion 86.

FIG. 8 shows a rail fastening similar to that of FIGS. 1 and 3, except the clip 153, seen in FIG. 11(*a*), is irremovable except by the application of special tools. Parts similar in function to those of the clip 53 are denoted by similar reference numerals raised by 100.

It may be noted that, similar to the clip 53, clip 153 has a lower portion 189 that bears on the extension 62 and is offset inwardly from the centre of curvature of the portion 187 to provide improved stress distribution as discussed above. In this case, however, the portion 189 extends downwardly into the pit 63. In installation, the end portion 186 may be inserted loosely manually into the opening 71 and the rear of the portion 187 given blows with a driving tool such as a hammer or slug to drive the clip 153 inwardly toward the position shown in FIGS. 31 and 32. The inner end portion 186 is urged upwardly as it rides on the upwardly inclining surface of the rail flange 48 or the insulator 54 disposed thereon, and the upper limb 184 is compressed more strongly as it progressively enters the opening 71. As a result, there is a strong downward compressive reaction at the lower portion 189. As the clip 153 is driven inward, the end portion 189 rides up the arcuate ramp portion 93 of the extension 62 and snaps into the pit 63 when it reaches the installed position. Because of the compressive reaction, the edges of the lower portion 189 tend to engage firmly in or bite in the surface of the pit 63, and therefore tend to resist attempts to lever the clip 153 outwardly from the shoulder 51 or 52, and therefore rendering the fastening device resistant to vandalism. The clip 153 may be removed by application of a special tool for example an hydraulically powered compression device which compresses the portions 184 and 189 toward one another in order to free the lower portion 184 from the pit 66 and permit lateral outward withdrawal of the clip 153.

FIGS. 9 shows a modified clip 53*a*, that comprises an upwardly bowed portion or corrugation 84*a* in the upper limb portion 84 extending inwardly adjacent the abutment surface 77 in the installed position, as seen in FIG. 26. The upwardly bowed portion 84*a* engages the surface 77, and provides increased resistance to migration of the clip 53*a* outwardly from its installed position as a result of impacts or vibration encountered in service.

Figure 10:
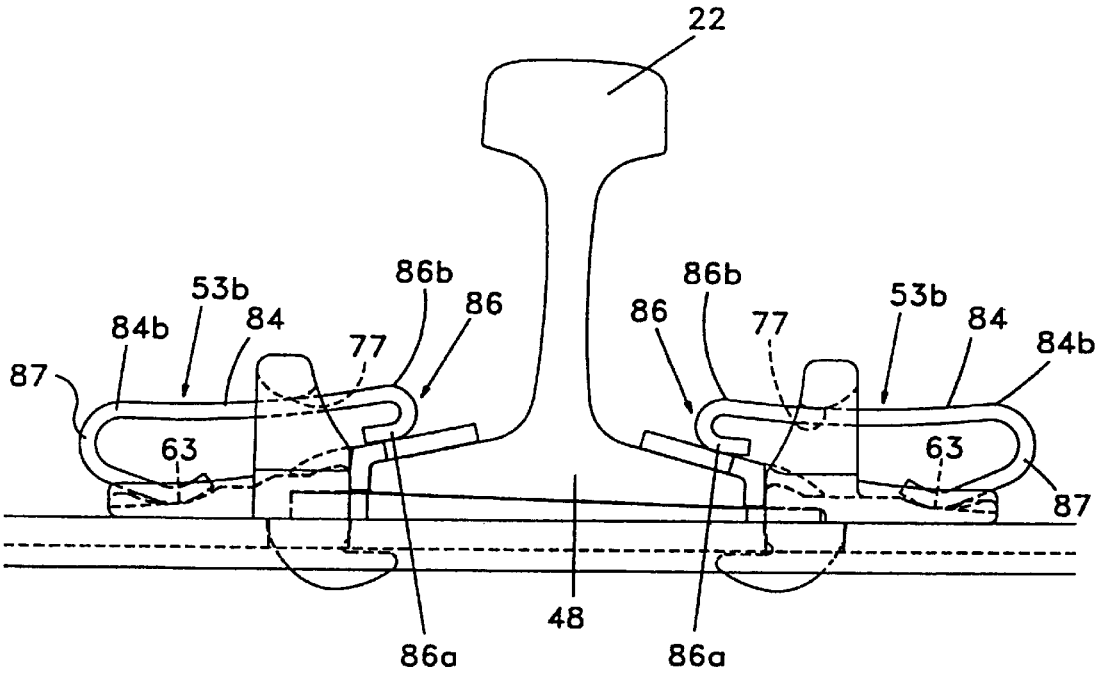

FIG. 10 shows a modified generally C-shaped or double J clip 53*b*, also seen in FIG. 11(*j*), wherein the end portion 86 is bent over laterally arcuately inwardly and downwardly to provide a U-shape the lower limb 86*a* of which bears compressively on the rail flange 48. The upper limb 86*b* is elevated above the outer end 84*b* of the upper limb portion 84 and the reaction with the surface 77 tends to urge the clip 53*b* inwardly and retain it in the installed position seen in FIG. 10 even if wear occurs of the outer edge of the pit 63. Preferably, to improve stress distribution, the zone of contact between the flange 48 and the lower limb 86*a* is offset outwardly from the centre of curvature of the U-shape and 86.

FIG. 11(*g*) shows a clip 53*c* generally similar to the clip 53 except the upper limb 84*c* and end portions 86*c* are of reduced width measured in the longitudinal direction with reference to rail 22 as compared with the arcuate portion 87*c* and remaining portions of the clip, whereby the clip 53*c* is provided with generally laterally inwardly inclining faces or shoulders 92 that may be engaged by tools and facilitate mechanized installation and de-installation of the clips.

FIG. 11(*i*) shows a further example 53*d* providing laterally inwardly arranged tool-engaging faces 92*a* except in this instance the lower limb portion and inner end portion 89*d* and 91*d* are of reduced width.

An advantage of the clips of the invention is that they allow separation of the installation stresses from in service stresses. Because of the stress reversal and improved stress distribution, the arcuate portion 87 or 187 is subject to relatively less stress or loading in service in resisting a tendency for the rail flange 48 to lift upwardly, for example to prevent rail rollover.

With the clips of the invention, therefore, because of the stress distribution and the avoidance of stress concentrations, the arcuate portions 87 or 187 or the clips as a whole may be made relatively thin, so that the clip as a whole is rendered compliant and easy to install, while still offering adequate strength to resist uplift of the rail flange. The clip 53*b* of FIGS. 10 and 11(*j*) is especially preferred because there is a double stress reversal, firstly at the end 84*b* and secondly at the end 86*b* and this gives especially good stress distribution.

FIG. 11(*c*) shows a modified form of clip 153*a* having a relatively thin arcuate portion 187*a*, so that the clip is relatively easy to install. The clip has a thickened upper limb portion 184*a* and lower portion 189*a* to provide a desired stiffness and resistance to rail flange uplift.

FIG. 11(*e*) shows a further modified form of clip 153*b* wherein the arcuate portion 187*b*, lower limb 188*b* and lower portion 189*b* are thin rendering the clip especially compliant and easy to install while the upper limb portion 184*b* and inner end portion 186*b* are relatively thick to provide adequate stiffness to resist rail flange uplift.

FIG. 11(*d*) shows a modified clip 53(*e*) similar to clip 53*a* of FIG. 9 except in place of upwardly bowed portion 84*a*, the upper limb portion 84 has an upwardly projecting circular boss 84*e* on the portion that extends inwardly of surface 77 in the installed position and resits outward movement of the clip 53(*e*).

FIG. 11(*f*) shows a further clip 53(*f*) similar to clip 53*a* except lower limb portion 89 is provided with a downwardly convex corrugation 89*f* of smaller radius that is better adapted to fit within a clip locating recess of small dimensions.

FIG. 11(*h*) shows a further clip 53*h* having a lower small radius portion 89*h* similar to portion 89*f* described above and a double corrugation 189 and 191 in the upper limb portion. The corrugations 189 and 191 extend outwardly and inwardly of the surfaces 77 in the installed portion and resist clip withdrawal or overdrive. That is the outer corrugation 189 engages the surface 77 to prevent the clip 53*h* from being driven too far inwardly in installation.

FIG. 12 shows a tie plate 201 formed in a single piece; for example by casting, suitable for installation on a concrete or wood tie. The plate 201 comprises a generally rectangular plate formed base 202 generally similar in its shape, configuration and mode of use to the tie plate described hereinafter with reference to FIGS. 39 to 46. The plate has a central portion tapering laterally in thickness with an inclined upper surface 203 to provide for cant of the rail 22. Upstanding from the plate 202 are two abutment members 204 having openings 205 through them somewhat similar to the opening 71 in the shoulder portions 51 and 52 described above with reference to FIGS. 1, 3, 4 and 5.

Outwardly from each portion 204, the plate 202 is formed with a pair of openings 207 spaced longitudinally apart.

In this example, the members 204 and 205 are spaced apart such that their lower inner surfaces 224, as seen in FIG. 13, snugly accommodate the rail flange 48 between them.

Outwardly from each opening 205, the upper side of the plate 202 is formed with a recess, in this case a rectangular recess 226 for accommodating a lower portion of a resilient clip preferably the small radius portion 89*f* or 89*h* of a clip such as clips 53*f* or 53*h* or lower portion 189 of an irremovable clip 153 described above with reference to FIG. 8.

It will be noted that the lower portion of each opening 205 is defined by an inwardly upwardly inclining ramp surface 227 commencing at the plane of the upper side of the plate 202 adjacent the outer side of opening 205, and terminating as seen in FIG. 13 at or slightly above the upper side of the flange 48 when received between the members 204.

Spikes 229 may be passed through openings 207 co retain the plate 201 on a wood tie 230, as seen in FIG. 14, or these openings 207 may receive studs or other cast in anchors of a concrete tie of the like.

In use, as seen in FIG. 14, a clip 53 may be inserted somewhat loosely through the opening 205 to the position shown in broken lines in FIG. 14 and driven inwardly to the installed position seen in solid lines. During initial application of the clips 53 to the plate 201, the inner ends 86 ride up the ramps 227, so that the outer edges of the flange 48 do not interfere with inward movement of the clips 53, thus greatly facilitating mechanized installation of clips such as clip 53.

A further advantage of the arrangement shown is that the box-form shoulders 204 offer considerably improved resistance to derailed dragging equipment.

In the preferred form, as seen in FIG. 14 the lower side of the plate 202 is provided with discrete wedge-shape projections 231 that taper laterally solely in the same direction as the central portion 203 and engage in the wood tie 230 and resist lateral displacement of the plates 201. It may by noted that as seen from FIGS. 13 and 14 each projection 231 is spaced inwardly from a longitudinal edge of the plate 201, and, as seen in FIG. 14, each wedge shape projection 231 tapers from an end face making an angle of 90° with the lower side of the plate 201.

Desirably, adjacent each recess 226, the plate 222 is provided with a drainage hole 232.

Desirably, as seen in FIG. 12, a transition portion 233 between the laterally outer portion 202 of the plate and the central portion 203 inclines inwardly upwardly and is provided with a rectangular opening 234 for reception of a conventional chisel-form rail road spike having a head engaging on the flange 48 as an adjunct to the use of the clips such as clip 53. Preferably, the openings 234 are offset from one another on opposite longitudinal sides of the members 204.

FIGS. 16 to 17 show examples of bent wire rod form clips 301 used with hook-in shoulders 51 and 52 similar to those described above on a tie 20 as described above. The rail flange 48 seats on an insulating cant plate 49, and the clips 301 bear on the flange 48 through insulators 54.

Each clip 301 is in the form of a bent rod symmetrical about a vertical plane, for example the plane indicated at A—A in FIG. 49 and extending laterally of the rail 22 in the installed position. Each clip 301 comprises an inner central portion 302 which bears downwardly on the rail flange 48, downwardly outwardly inclining limb portions 303 which bear upwardly on the downwardly facing abutment surfaces 77 and outer portions 304 which bear resiliently on the seating portions 62 of the shoulders 51 and 52. Each outer portion 304 is in the form of a coil spring of which, as seen especially in FIGS. 18 and 19 a substantial portion extends in a vertical plane parallel to the plane A—A, thereby reducing torsional stresses in the clip 301 in service.

In the example shown in FIGS. 16 to 20, the coil spring or spiral portion 304 extends arcuately, as seen for example in FIG. 20 through greater than 360° and terminates in an end portion 306 extending arcuately upwardly outwardly. An arcuate portion 307 spaced inwardly from the end 306 bears in the pit 63 of the seating portions or extension 62. Preferably, to increase resistance to squatting or compression of the coil portion 304, the end portion 307 are inclined with respect to the vertical plane A—A. In the example shown in FIGS. 16 to 20, the portions 307 are toed outwardly so that, on upward compression of the inner central portion 302 the end portions 307 engage compressively outwardly against the anti-squat wall portions 64. In other embodiments, the end portions 307 may be toed inwardly toward the plane A—A and may engage inwardly compressively on the end surfaces 67 of the portion 66 to provide resistance to compression-induced squatting.

By virtue of the fact that the coil spring portion 304 is a spiral extending arcuately through more than 360°, the rod form clip 301 is highly compliant. The generally vertical orientation of the coil spring 304 as seen in, for example, FIG. 19 greatly reduces the torsional stresses to which the clip is subjected in service.

FIGS. 21 to 26 illustrate a further wire rod form clip 401 used together with hook-in shoulders 51 and 52, a tie 20, insulating cant plate 49 and insulators 54.

The rail clip 401, which may be formed of relatively thin gauge bent metal rod is again symmetrical about a vertical plane transverse to the rail 22 and comprises an outer central portion 402 that bridges longitudinal between outer lower limb portions 403. A lower pair of intermediate limb portions 404 extend arcuately upwardly from the portions 403. A pair of upper limb portions 406 extend generally parallel to the lower portions 404 and connect to them through a sharply arcuately upwardly extending transition 407. The upper limb portions 406 are spaced apart longitudinally a smaller distance than the lower portions 404, as seen in FIG. 25. The upper limb portions 406 sweep outwardly upwardly through a transition portion 408 which in service contacts the abutment surface 77 and extend outwardly to upper limb portions 409 the ends of which 411 in an unstressed position as seen in FIG. 21 are spaced a short distance above the longitudinal portion 402.

The spacing of the lower limb portions 404 is such that when the clip 401 is installed, the outer sides of the portions 404 engage snugly against opposing side faces 71*a* and 71*b* of the opening 71, as seen in FIG. 25. In the installed position, as seen in FIG. 53, the upper limb portions 406 are displaced slightly downwardly toward the lower limb portions 404 as compared with the as-manufactured condition, whereby there is a resilient downward reaction at the inner portion 407 bearing downwardly on the rail flange 48.

The clips 401 effectively serve to guard against uplift of the flange 48 or rollover of the rail 22. Upward pressure on the inner portions 407 of the lower limb portions 404 result in a greatly increased downward reaction between the abutment surface 77 and the upper limb portions 406, so that these are displaced downwardly into contact with the lower limb portions 404, as seen in FIG. 26 thus providing in effect a beam of greatly increased depth, strength and stiffness as compared with the individual rod components of the clip 401. Any reaction tending to cause spreading of the limb portions 404 is resisted by the side walls 71*a* and 71*b*. As a result, there is greatly increased reaction on the flange 48 at and beyond the state illustrated in FIG. 26.

Further, the toe or inner end portions 407 of the limb portions inwardly of the shoulder 51 spread apart and engage on the side walls 71*a* and 71*b* of the shoulder and resist any tendency for outward movement of the clip 401 relative to the shoulder 51.

Further, with the embodiment shown in the drawings, upward rotation of the rail flange 48 is resisted by the upper limb portions 409 being displaced downwardly into contact with the bridging portion 402 to provide increased stiffness.

It will be appreciated from consideration of, for example FIG. 21, the clips 401 may be relatively easily installed, as with the other clips described above, by insertion of the inner end portion 407 within the opening 77 somewhat loosely, and applying pressure to the outer end portions 402 and 411 to drive the clips inwardly to the installed position seen in FIGS. 21 and 22 wherein the lower portion 403 lodges in the pit 63, the clip is compressed between surfaces 77 and 63 and there is a downward toe load exerted by the inner portion of the clip, for example portions 407 on the rail flange 48.

FIGS. 27 to 30 illustrate rail retaining devices in accordance with further aspects of the invention.

In the example illustrated, a first canted rail 22*a* is a loaded or running rail forming one of a pair of rails comprising a rail track. The other loaded or running rail is not shown in the drawings.

On the inner or gauge side of the running rail 22*a* is provided a guard rail 22*b* which serves to catch or retain the wheels of rolling stock in the event of derailment from rail 22*a*.

The rails 22*a* and 22*b* are supported on plate form support members 501, which may be, for example, an upper flange of an I-beam. The rails 22*a* and 22*b* are retained by retaining devices comprising hook-in shoulders 502 and 503 of different heights in the case of the canted rail 22*a*, and 504 in the case of the rail 22*b*, cooperating with rail clips 506 which are of bent rod form symmetrical about a vertical plane extending laterally of the rail. These clips 506 are adapted to cooperate with the shoulders 502, 503 and 504 to retain the rails and prevent rail roll over and the like while exerting zero load on the rail flanges 48 and therefore allowing longitudinal movement of the rails 22*a* and 22*b* relative to the shoulders 502 to 504 and the supports 501. For example, the supports 501 may be the supporting members of a bridge construction and it may be desirable to allow longitudinal movements of the rails relative to the bridge construction such as may result from thermal expansion and contraction effects.

As best seen in FIGS. 29 and 30, each bent rod clip 506 comprises inner portions 507 adapted to engage on the rail flange either directly or on insulators 54, these inner portions having upswept ends, and intermediate limb portions 508 adapted to engage upwardly on the upper sides or abutment surfaces of the openings 509 provided in the shoulders 502 to 504 and outer portions 511 comprising central portions of the rod and adapted to react on bearing surfaces constituted by laterally outward projections 512 of the shoulders 502 and 503 and projections 513 of the shoulders 504. Between the portions 507 and 508, the clip 506 tapers laterally outwardly in width (as measured in the direction longitudinally of the rail) from an inner wider portion 514 to a portion of reduced width 516. The portion 514 is substantially wider than the length of the opening 509 in the shoulders 502 to 504. In use, the clips 506 are driven inwardly through the openings 509, the bent rod clip 506 compressing in width as it is driven inwardly through the opening. Once installed, displacement of the clip 506 laterally of the shoulder 502, 503 or 504 is resisted by engagement of the tapering portion between portions 514 and 516 with the edges of the openings 509. In the installed position, the clips 506 extend approximately horizontally, as seen in FIG. 27. The shoulders 504 employed for the guard rail 22*b* have a central lateral extension 513 which is accommodated in an upwardly swept central portion 517 of the clip 506. In the case of the load bearing rail 22*a*, the inner ends 507 of the clips 506 are somewhat elevated relative to the support surface 501, and the shoulders 502 and 503 have elongated platform like extension 512, which support portions of the clips 506 outwardly from the central portion 517. In the normal position shown in FIGS. 27 and 28, there is substantially zero reaction between the clips 506 and the flanges 48 of the rails 22*a* and 22*b*, substantially the only reaction arising from the weight of the clip 506 bearing on the rail flanges and on the lateral extension 512 and 513.

In the event of a wheel derailing from rail 22*a* and moving laterally toward rail 22*b*, displacement or rotation of the rail 22*b* is resisted by the combination of the shoulders 504 and clips 506. For example, considering the clip 506 and shoulder 504 on the inner side of rail 22*b* adjacent rail 22*a*, the reaction would tend to rotate clip 506 in an anticlockwise sense, and such rotation is resisted by the engagement of the upper side of the clip 506 on the abutment surface provided by the upper side of the opening 504, which tends to function as a pivot. Downward rotation of the outer end portion 511 is resisted by its engagement on the lateral extension 512. The downward pressure exerted by the clip portion 511 on the extension 512 resists any tendency for retraction of the hook portions 59 from the openings through which they are passed in the flange or other plate-like support 501.

What is claimed is:

1. A rail and tie plate suitable for attachment to a wood tie, comprising:

a base plate adapted to be applied to the tie and a pair of abutment members upstanding therefrom to accommodate therebetween a rail having a rail flange portion on each side, each rail flange portion having a laterally outer edge and an upper side, each laterally outer edge of each rail flange portion engaged by a lower laterally inner side of a respective abutment member, each abutment member providing a downwardly facing upper abutment surface for reaction with a laterally inwardly inserted rail clip, and an upwardly facing lower ramp surface defining a lower side of an opening extending through said abutment member and inclining from a laterally outer side of each abutment member upwardly to a termination on a laterally inner side thereof at least as high as said upper side of said rail flange portion engaged thereby, said lower ramp surface terminated at a planar surface of an upper side of said plate outwardly of the abutment members, for facilitating insertion of the clip through said opening to an installed position wherein an inner end of the clip bears resiliently on an inner side of the rail flange and, said plate having a central portion between the abutment members that tapers in thickness and has an upper side canted with respect to the lower side thereof and said lower side is provided with discrete wedge shape projections spaced inwardly from a longitudinal edge of said plate said projections having vertical surfaces facing in a direction of increasing thickness of the central portion of the plate.

2. A rail and tie plate as claimed in claim 1 comprising a plate portion laterally outward of each abutment member formed with a pit in its upper side for location of an outer end of said clip.

3. A rail and tie plate as claimed in claim 2 comprising a hole through the plate portion distinct from and coincident with the pit for drainage thereof.

4. A rail and tie plate as claimed in claim 1 wherein a central portion between the abutment members has an upper side offset upwardly from an outer plate portion outward of each abutment member, and comprising a transition portion inclining inwardly from said outer plate portion upwardly toward said central portion longitudinally outward from the abutment member, and a rectangular opening in each transition portion for reception of a spike.

5. A rail and tie plate as claimed in claim 1 wherein said wedge shape projections taper laterally solely in the same direction as the central portion, each wedge shape projection having an end face making an angle no greater than 90° with said lower side.

6. A rail and tie plate as claimed in claim 5 wherein said angle is substantially 90°.

* * * * *